US009067732B2

(12) United States Patent
Wang et al.

(10) Patent No.: US 9,067,732 B2
(45) Date of Patent: Jun. 30, 2015

(54) FOOT OPERATION CONTAINER

(71) Applicants: Xin Wang, Fujian (CN); Jiangqun Chen, Fujian (CN)

(72) Inventors: Xin Wang, Fujian (CN); Jiangqun Chen, Fujian (CN)

( * ) Notice: Subject to any disclaimer, the term of this patent is extended or adjusted under 35 U.S.C. 154(b) by 0 days.

(21) Appl. No.: 13/815,343

(22) Filed: Feb. 22, 2013

(65) Prior Publication Data

US 2014/0238989 A1 Aug. 28, 2014

(51) Int. Cl.

| | |
|---|---|
| ***B65D 43/26*** | (2006.01) |
| ***B65F 1/14*** | (2006.01) |
| *B65F 1/16* | (2006.01) |

(52) U.S. Cl.

CPC ..... *B65F 1/163* (2013.01); *Y10T 29/49826* (2015.01); *B65F 2001/1661* (2013.01)

(58) Field of Classification Search

CPC ..... B65F 1/163; B65D 90/582; B65D 90/587
USPC ..... 220/262, 263, 264, 908, 908.1
See application file for complete search history.

(56) References Cited

U.S. PATENT DOCUMENTS

| | | | | |
|---|---|---|---|---|
| 4,996,467 | A * | 2/1991 | Day | 318/480 |
| 5,671,859 | A * | 9/1997 | Sheu et al. | 220/263 |
| 6,390,321 | B1 * | 5/2002 | Wang | 220/264 |
| 7,108,148 | B2 * | 9/2006 | Lu | 220/263 |
| 8,308,009 | B2 * | 11/2012 | Joordens | 220/264 |
| 8,418,869 | B2 * | 4/2013 | Yang et al. | 220/264 |
| 2010/0170904 | A1 * | 7/2010 | Kalman et al. | 220/495.01 |

* cited by examiner

*Primary Examiner* — Anthony Stashick
*Assistant Examiner* — James Way
(74) *Attorney, Agent, or Firm* — Raymond Y. Chan; David and Raymond Patent Firm

(57) ABSTRACT

A foot operation container includes a garbage bin having a bin lid, a foot-operable pedal mounted to the garbage bin, a pedal guide arrangement mounted to the garbage bin for enabling downward and upward movement of the foot-operable pedal, and a driving arrangement connected to the bin lid and the bin lid, wherein when the foot-operable pedal is pressed by a foot of a user, the foot-operable pedal moves downward under a guidance of the pedal guide arrangement to drive the pulling thread to lift up the bin lid. A pedal cushion arrangement is also provided to provide a cushion effect to avoid the production noise when the foot-operable pedal is released from the foot of the user.

7 Claims, 12 Drawing Sheets

FOOT OPERATION CONTAINER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a garbage bin, and more particularly to a foot-operable pedal bin.

2. Description of Related Arts

With the increase of living standards among human beings and the shift of the concept of life, the increasing requirements for garbage bins with nontraditional appearances and functions have been growing. In addition, the requirements for quality, room decoration, and "green environmental protection" also have been growing higher and higher. A conventional garbage bin, especially a common pedal bin having a volume of 8-100 L, employs a system with a pedal for opening the lid of the garbage bin. This type of system generally has a lever type pedal arrangement for driving a pull rod or a push rod to open the lid of the garbage bin. This type of lid-open system comprises a large quantities of components; the related requirement is relatively high and the adjustment of the system is relatively complex. In addition, the lid closing operation produces a relatively loud noise, so that a high performance cushion system is required to prevent the production of noise and thus the manufacturing costs are increased. Furthermore, the bin top and bin bottom of the conventional garbage gin are respectively mounted to the bin body by screws. This type of connection manner requires internal connecting elements, making it inconvenient to assemble and the quality of the assemble cannot be ensured. In addition, the manufacturing costs are increased because of the internal connecting elements and screws. There is another type of electrical garbage bin among the conventional garbage bins which uses electric battery to provide a power supply to open and close the lid of the garbage bin. However, the consumption and improper disposing of the battery of this type of garbage bin will result in environmental pollution.

SUMMARY OF THE PRESENT INVENTION

The main object of the present invention is to provide a foot operation container that comprises a simple mechanism for opening and closing a bin lid of the foot operation container, so that few components are required and the operation of the pedal bin is easy.

Another object of the present invention is to provide a foot operation container that comprises a pedal cushion arrangement, wherein when a pedal of the foot operation container is released from a foot of a user, the pedal cushion arrangement provides a cushion effect to the pedal, so that the bin lid of the foot operation container slowly folds toward a bin top of the foot operation container and thus noise during the closing process is prevented.

Another object of the present invention is to provide a foot operation container, wherein a bin top and a bin bottom are respectively connected to a bin body of the foot operation container via barb structures, so that it is easy to assemble the foot operation container and thus mounting screws are eliminated during assembly of the foot operation container.

Another object of the present invention is to provide a foot operation container that comprises only mechanical structures, so that the foot operation container is user-friendly and produces no pollution to the environment.

Another object of the present invention is to provide a foot operation container which has a simple structure to reduce the manufacturing costs, thus the foot operation container can be affordable to all consumers.

Additional advantages and features of the invention will become apparent from the description which follows, and may be realized by means of the instrumentalities and combinations particular point out in the appended claims.

According to the present invention, the foregoing and other objects and advantages are attained by a foot operation container comprising a garbage bin comprising a bin lid, a foot-operable pedal mounted to the garbage bin, a pedal guide arrangement mounted to the garbage bin for enabling downward and upward movement of the foot-operable pedal, and a driving arrangement connected to the bin lid and the bin lid, wherein when the foot-operable pedal is pressed by a foot of a user, the foot-operable pedal moves downward under a guidance of the pedal guide arrangement to drive the pulling thread to lift up the bin lid. A pedal cushion arrangement is also provided to provide a cushion effect to avoid noise when the foot-operable pedal is released from the foot of the user.

In accordance with another aspect of the invention, the present invention provides method for manufacturing foot operation container, comprising the following steps.

(a) Form a storing cavity with an opening for carrying items via a garbage bin having a bin lid.

(b) Mount a foot-operable pedal and a pedal guide arrangement to the garbage bin in such a manner that the foot-operable pedal is capable of moving downward and upward under a guidance of the pedal guide arrangement.

(c) Connect the foot-operable pedal and the bin lid via a pulling thread of a driving arrangement in such a manner that when the foot-operable pedal moves to pull the pulling thread, the pulling thread is driven to pull up the bin lid to open the opening of the garbage bin.

The method may further comprises a step (d) of mounting a pedal cushion arrangement to the foot-operable pedal in such a manner that the friction between a main motor and a reduction gear box of the pedal cushion arrangement provides a resisting force to the foot-operable pedal via a crank connecting rod, so that retracting movement of the foot-operable pedal is provided with a cushion effect.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
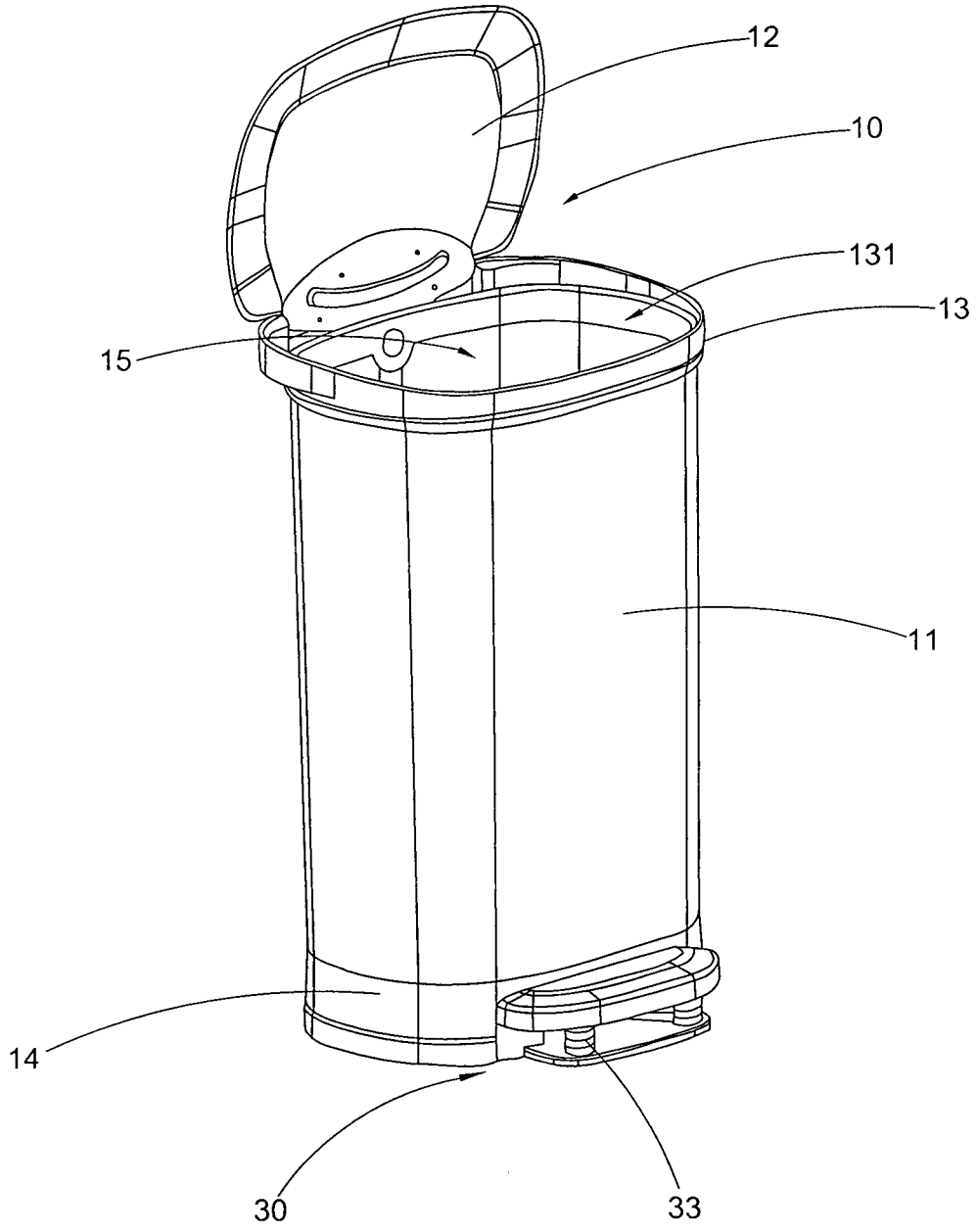
FIG. 1 is a perspective view illustrating a foot operation container in an open state according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 10 of the drawings, a foot operation container according to a preferred embodiment of the present invention is illustrated. The foot operation container comprises a garbage bin 10, a foot-operable pedal 20, a pedal guide arrangement 30, a driving arrangement 40, and a pedal cushion arrangement 50.

Accordingly, the garbage bin 10 further comprises a bin body 11, a bin lid 12, a bin top 13, and a bin bottom 14. The bin lid 12 is mounted to the bin top 13 and is arranged for folding between an open state and a closed state. The bin top 13 and the bin bottom 14 are respectively mounted to opposite ends of the bin body 11 so as to define a storing cavity 15 for carrying waste garbage. Accordingly, the bin top 13 defines an opening 131. The bin lid 12 is designed for sealing the opening 131. The bin bottom 14 seals off a bottom side of the bin body 11 so that the garbage bin 10 can be used for storing garbage.

The foot-operable pedal 20 is connected to the garbage bin 10 via the pedal guide arrangement 30 in such a manner that when the foot-operable pedal 20 is pressed by a foot of a user, the pedal guide arrangement 30 is activated to guide the foot-operable pedal 20 to move downward along a predetermined route. Since the driving arrangement 40 comprises a pulling thread 41 having a first end connected to the bin lid 12 and a second end connected to an end portion of the foot-operable pedal 20, the downward moving foot-operable pedal 20 drives the driving arrangement 40 to open the bin lid 12.

Figure 2:
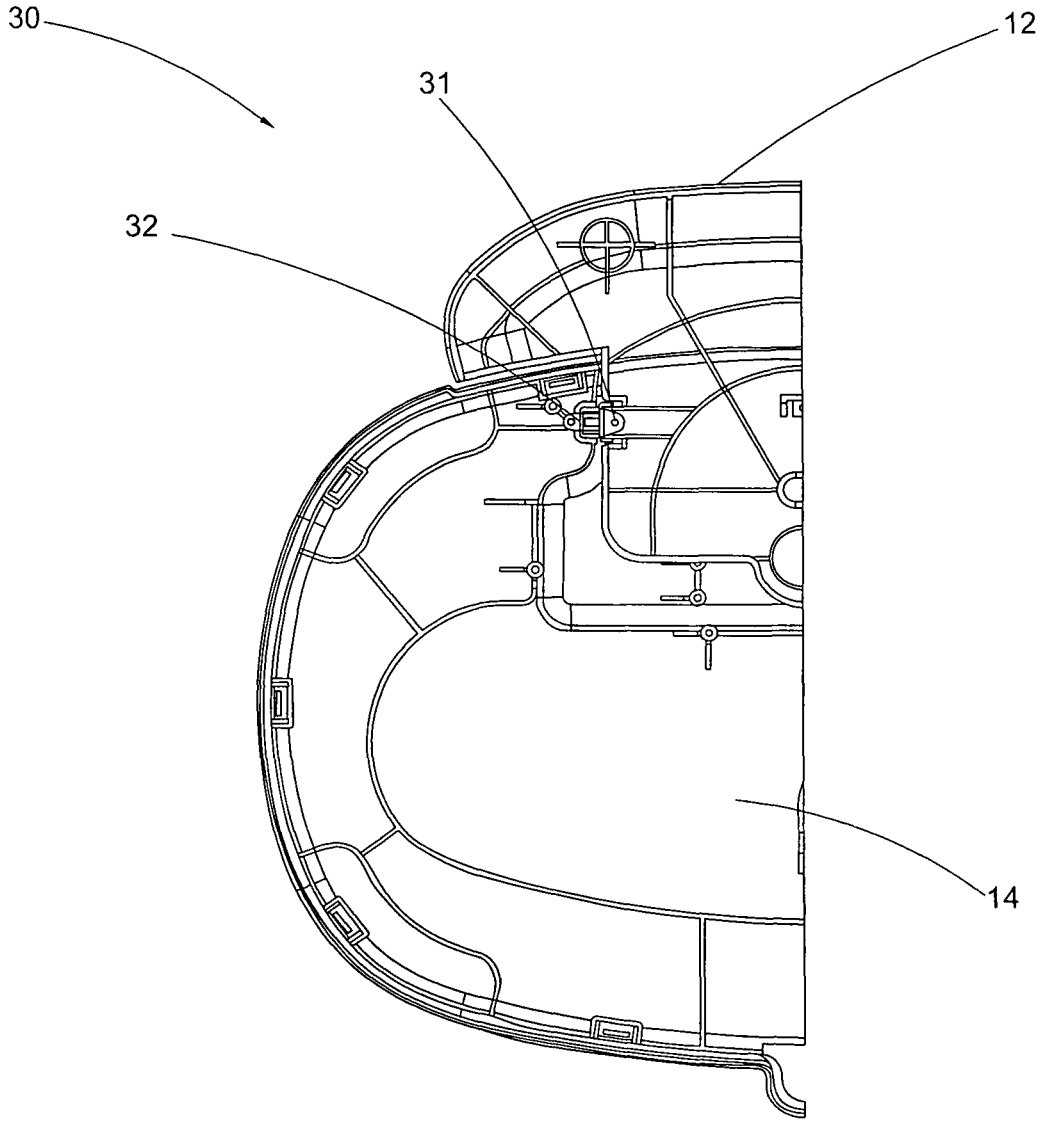
FIG. 2 is a top view of a pedal guide arrangement of the foot operation container according to the above preferred embodiment of the present invention.
Figure 3:
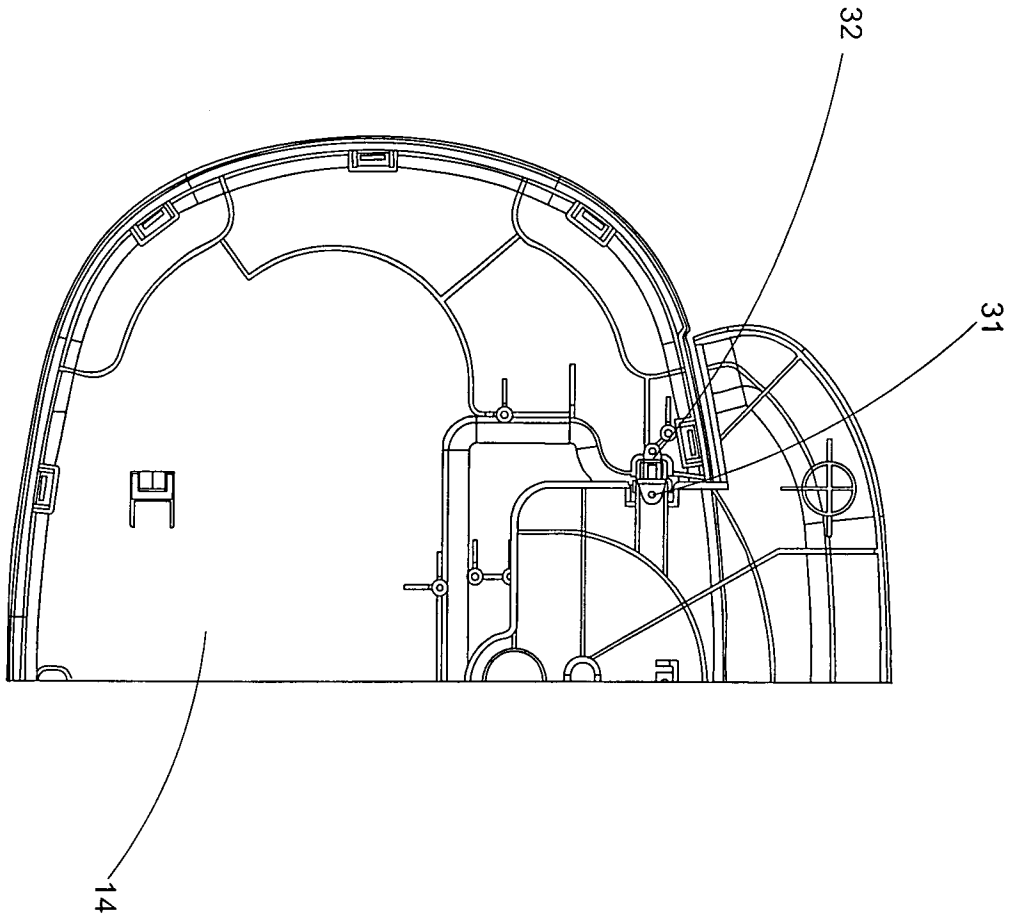
FIG. 3 is a bottom view of the pedal guide arrangement of the foot operation container according to the above preferred embodiment of the present invention.
Figure 4:
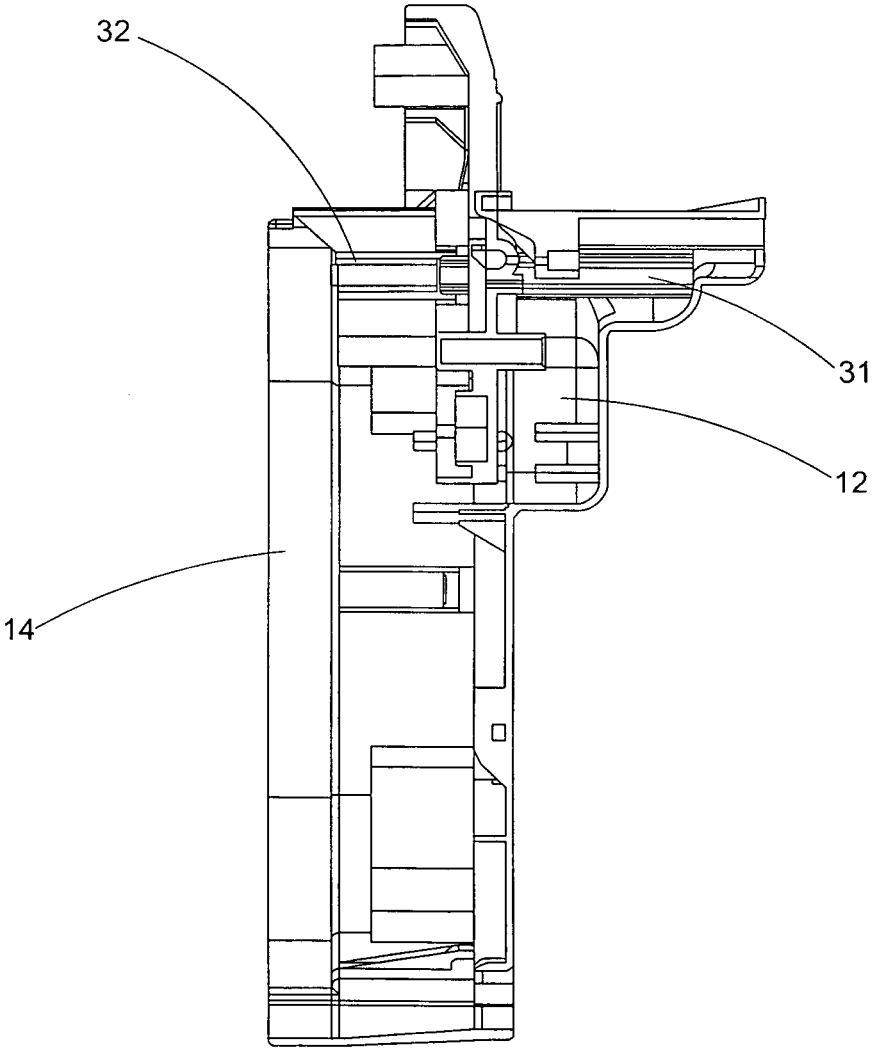
FIG. 4 is a sectional view of the pedal guide arrangement of the foot operation container according to the above preferred embodiment of the present invention.

More specifically, as shown in FIGS. 2 to 4 of the drawings, the pedal guide arrangement 30 is illustrated in detail. Accordingly, the pedal guide arrangement 30, which enables a precise downward movement of the foot-operable pedal 20, comprises a movable guide rail 31 and a retaining guide rail 32. The retaining guide rail 32 is firmly mounted to the garbage bin 10.

According to this preferred embodiment, the retaining guide rail 32 is fixed to the bin bottom 14. The movable guide rail 31 is coupled with the retaining guide rail 31 in such a manner that the movable guide rail 31 is capable of sliding along the retaining guide rail 32. The movable guide rail 31 is coupled with the foot-operable pedal 20 in such a manner that the foot-operable pedal 20 is guided to move downward with the movable guide rail 31, so that the foot-operable pedal 20 is directed to a predetermined orientation.

In other words, the pedal guide arrangement 30 guides the foot-operable pedal 20 to move in a proper line to perform its function. More specifically, since a second end of the pulling thread is connected to the end portion of the foot-operable pedal 20, the downward movement of the foot-operable pedal 20 will pull the pulling thread 41 to corresponding move so as to lift up the bin led 12 of the garbage bin 10 via a first end of the pulling thread 41.

It is worth mentioning that the movable guide rail 31 is capable of sliding along the retaining guide rail 32. The sliding engagement between the movable guide rail 31 and the retaining guide rail 32 facilitates the operation of the foot-operable pedal 20 by the user. In other words, when the user simply put his or her foot on the foot-operable pedal 20, the foot-operable pedal 20 will slide downward along the retaining under the guide of the movable guide rail 31 automatically, thus this trigger mechanism is user-friendly. The sliding movement along the retaining guide rail 32 of the movable guide rail 31 can be achieved by roller bearings.

The pedal guide arrangement 30 further comprises at least one spring 33 provided between the bin bottom 14 and the foot-operable pedal 20. When the foot-operable pedal 20 is moving downward, the spring 33 is used for preventing the bin body 11 from shaking. After the foot-operable pedal 20 is released from a foot of the user, the spring 33 is also released so that the foot-operable pedal 20 returns to its original position via the spring 33.

Accordingly, in this preferred embodiment, when the foot operation container shifts from the closed state to the open state, the spring 33 can be compressed to pull tight the bin bottom 14 so as to retain the bin body 11 in position, and thus the bin body 11 will not tip over or shake sideward; when the foot operation container shifts from the open state to the closed state, the spring 33 retracts to its original shape so that the foot-operable pedal 20 moves back to original position along the retaining guide rail 32 with the help of the movable guide rail 31.

Figure 5:
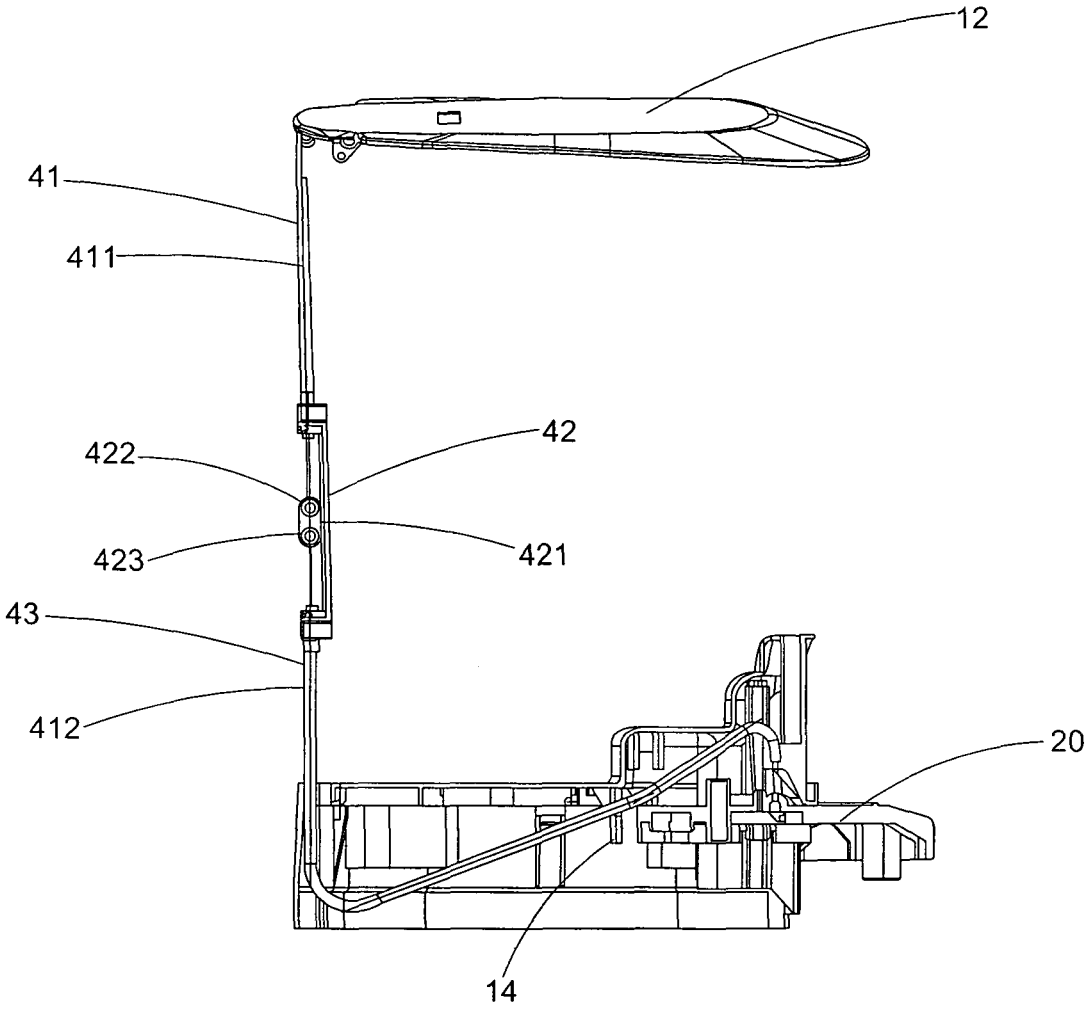
FIG. 5 is perspective view of a driving arrangement of the foot operation container according to the above preferred embodiment of the present invention.
Figure 6A:
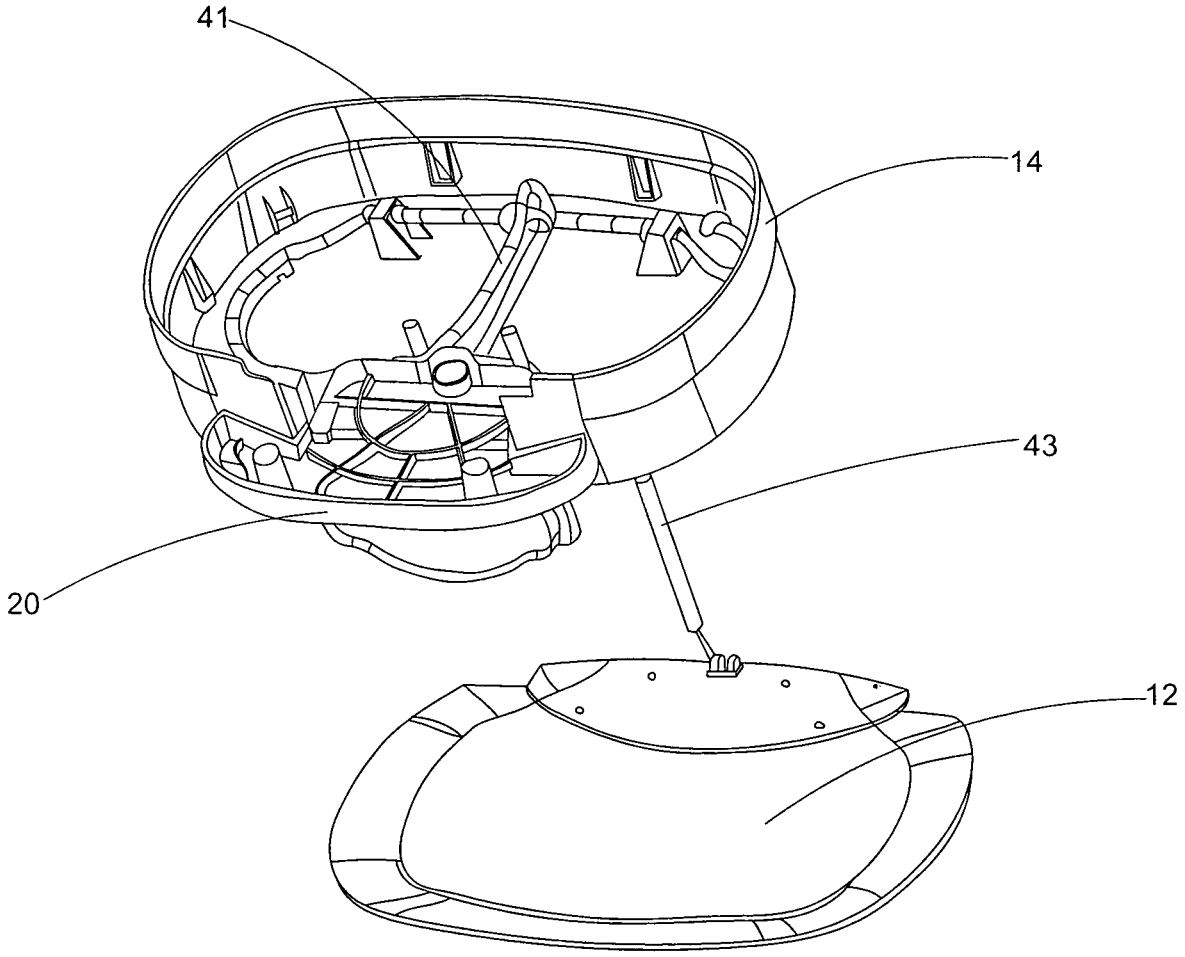
FIG. 6A to 6C are schematic views illustrating the driving arrangement of the foot operation container according to the above preferred embodiment of the present invention.
Figure 6B:
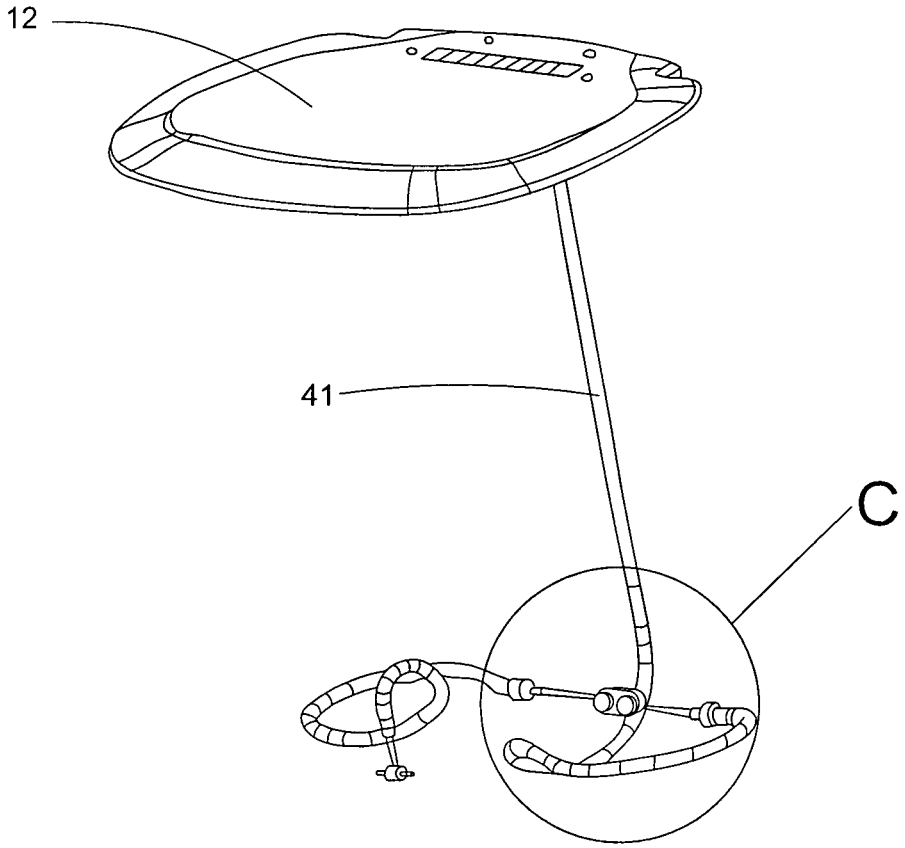
Figure 6C:
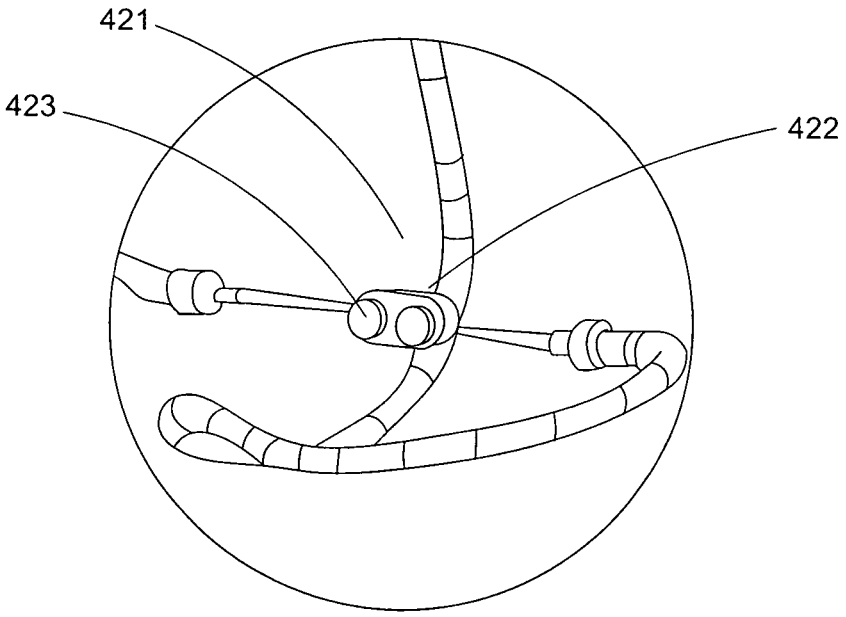

Referring to FIGS. 5 to 6C of the drawings, the driving arrangement 40 is illustrated in detail. Accordingly, as shown in FIG. 6A of the drawings, a first end of the pulling thread 41 can be mounted to a distal edge of the bin lid 12 so that when the foot-operable pedal 20 is stepped on to pull the pulling thread 41 of the driving arrangement 40, the bin lid 12 is quickly lifted up at the distal edge of the bin lid 12. It is worth mentioning that the first end of the pulling thread 41 can be mounted at any location of the bin lid 12 as long as the pulling thread 41 is capable of effectively lifting up the bin lid 12. It is worth mentioning that the pulling thread 41 also can be made of flexible and resilient material.

Unlike the pull rod or push rod in a convention pedal bin using a lever type arrangement for opening and closing the bin lid, the present invention uses thread, ropes, or wires to lift up the bin lid 12, and thus the total structure is simplified and the thin and elongated pulling thread 41 is much easier to be installed into the foot operation container. Therefore, the total size of the pedal bin can be minimized.

Referring to FIGS. 6A to 6C of the drawings, the driving arrangement 40 further comprises an adjusting arrangement 42 for adjusting an effective length of the pulling thread 41. According to this preferred embodiment, the pulling thread 41 comprises a first thread section 411, and a second thread section 412. The adjusting arrangement 42 comprises a connecting element 421 that connects the first thread section 411 and the second thread section 412.

More specifically, an end of the first thread section 411 is mounted to the connecting element 421 via a first mounting screw 422, while an end of the second thread section 412 is also mounted to the connecting element 421 via a second mounting screw 423. When a length of the pulling thread 41 is relatively long, simply by adjusting the first and second muting screws 422 and 423, the extra section of the pulling thread 41 is picked and pulled out so as to adjust the effective length of the pulling thread 41. Thus, accurate sealing of the bin lid 12 at the opening 131 of the bin top 13 can be ensured.

Since the effective length of the pulling thread 41 can be adjusted according to practical requirements, the driving arrangement 40 actually can be adjusted to fit any size of the foot operation container. In other words, for foot operation container having different volumes, such as foot operation container having volumes arranged from 8 L to 20 L, the effective length of the pulling thread 41 can be shortened or prolonged according to a height of the bin body 12 of the foot operation container. Therefore, the driving arrangement 40, the pedal 20, and the pedal guide arrangement 30 actually can be installed into any garbage bin having a bin lid without altering the original structure of the conventional garbage bin.

As shown in FIGS. 6A to 6C of the drawings, the driving arrangement 40 further comprises a thread sleeve 43, wherein the pulling thread 41 is received and extended in the thread sleeve 43. Accordingly, the thread sleeve 43 protects the pulling thread 41 from contacting with surfaces of the garbage bin 11. In other words, the repeat movement of the pulling thread 41 will not damage the bin body 11 of the foot operation container, and the pulling thread 41 itself is also not easy to break down through the protection of the thread sleeve 43.

Figure 7:
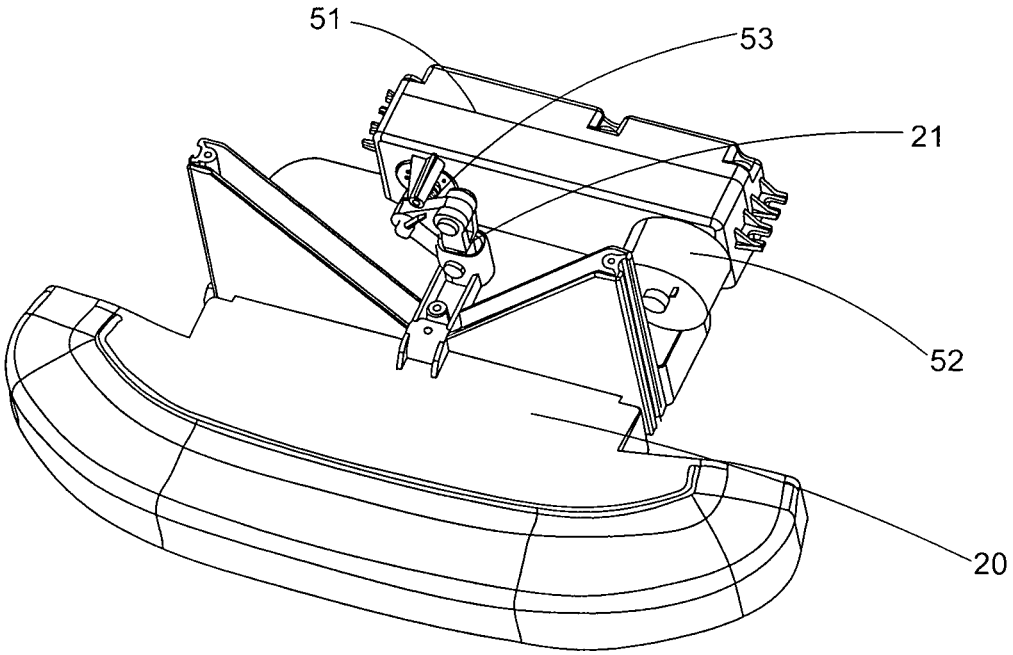
FIG. 7 is a perspective view of a pedal cushion arrangement of the foot operation container according to the above preferred embodiment of the present invention.

Referring to FIG. 7 of the drawings, the pedal cushion arrangement 50 of the foot operation container comprises a reduction gear box 51, a main motor 52, and a crank connecting rod 53. The reduction gear box 51 is directly connected to the main motor 52. The crank connecting rod 53 is mounted on the reduction gear box 51. Correspondingly, the foot-operable pedal 20 is provided with a guide hole 21. The guide hole 21 is in floating connection with the crank connecting rod 51, so that when the foot-operable pedal 20 is released from a foot of the user, the upward retracting force of the foot-operable pedal 20 from the spring 33 is transmitted to the crank connecting rod 51 via the guide hole 21. Thus gears in the gear box 51 are activated to rotate, since the main motor 52 provides a resisting force to the gear box 51, and the rotation speed of the gears in the gear box 51 is decreased. Therefore, the bin lid 12 will not fall down quickly to produce a loud noise.

Therefore, when a user wants to open the bin lid 12 of the foot operation container, he or she just steps on the foot-operable pedal 20 and then the foot-operable pedal 20 will move downward along the retaining guide rail 32 via the movable guide rail 31. During the downward movement of the foot-operable pedal 20, the spring 33 of the pedal guide arrangement 30 is elastically deformed to retain the garbage bin 10 in position. At the same time, the pulling thread 41 of the driving arrangement 40 mounted on the foot-operable pedal 20 is driven to pull up the bin lid 12, so that the user can put garbage into the bin body 11 of the garbage bin 10. When the foot of the user is moved away from the foot-operable pedal 20, the spring 33 of the pedal guide arrangement 30 returns to its original position, and thus the movable guide rail 31 is guided to move back along the retaining guide rail 31. The foot-operable pedal 20 is also driven to move back along with the movable guide rail 31. During the retraction process, the upward movement of the foot-operable pedal 20 will activate the crank connecting rod 53 via the guide hole 21 of the foot-operable pedal 20, and thus the main motor 52 restricts the upward moving speed of the foot-operable pedal 20 through providing a resisting force to the reduction gear box 51. Therefore, the bin lid 12 can slowly fall down on the bin top 13 and noise during the closing process can be avoided.

Figure 8:
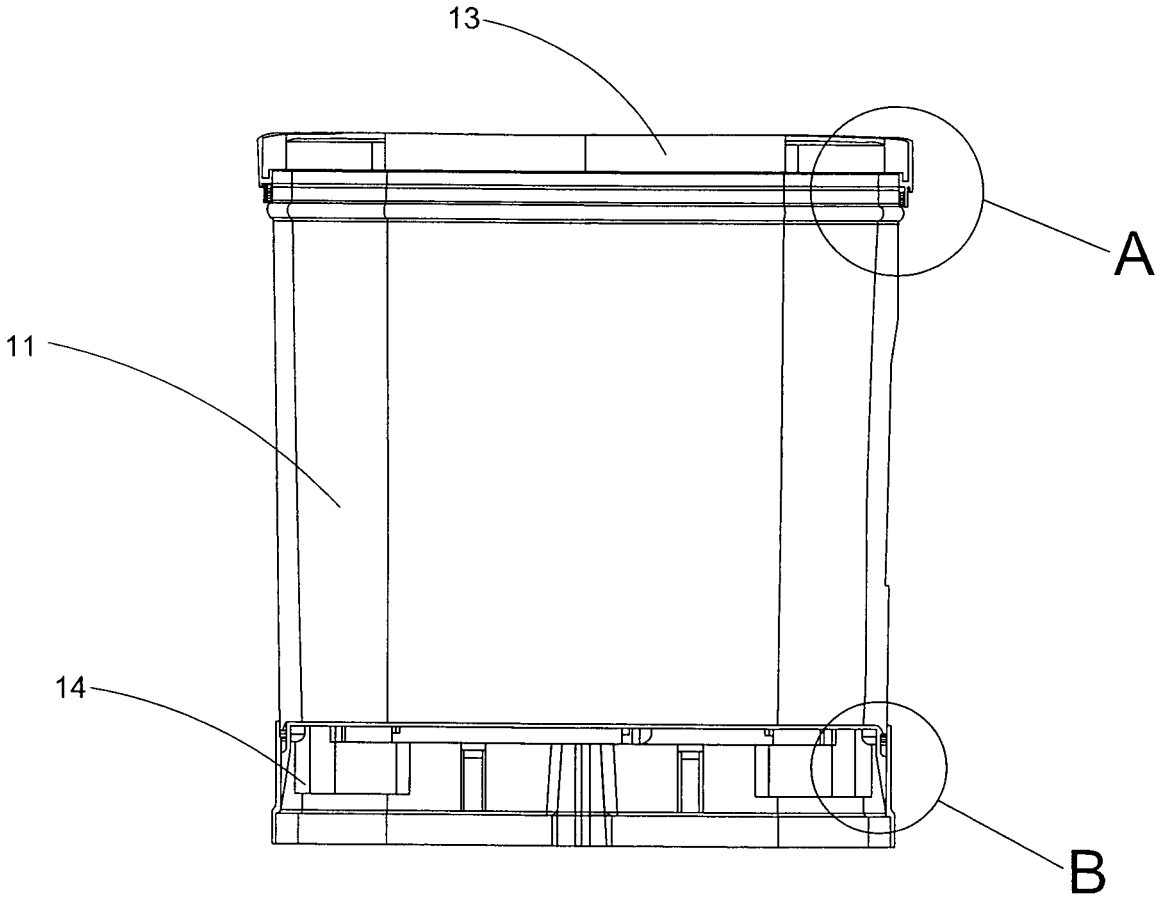
FIG. 8 is a sectional view of the foot operation container according to the above preferred embodiment of the present invention.
Figure 9:
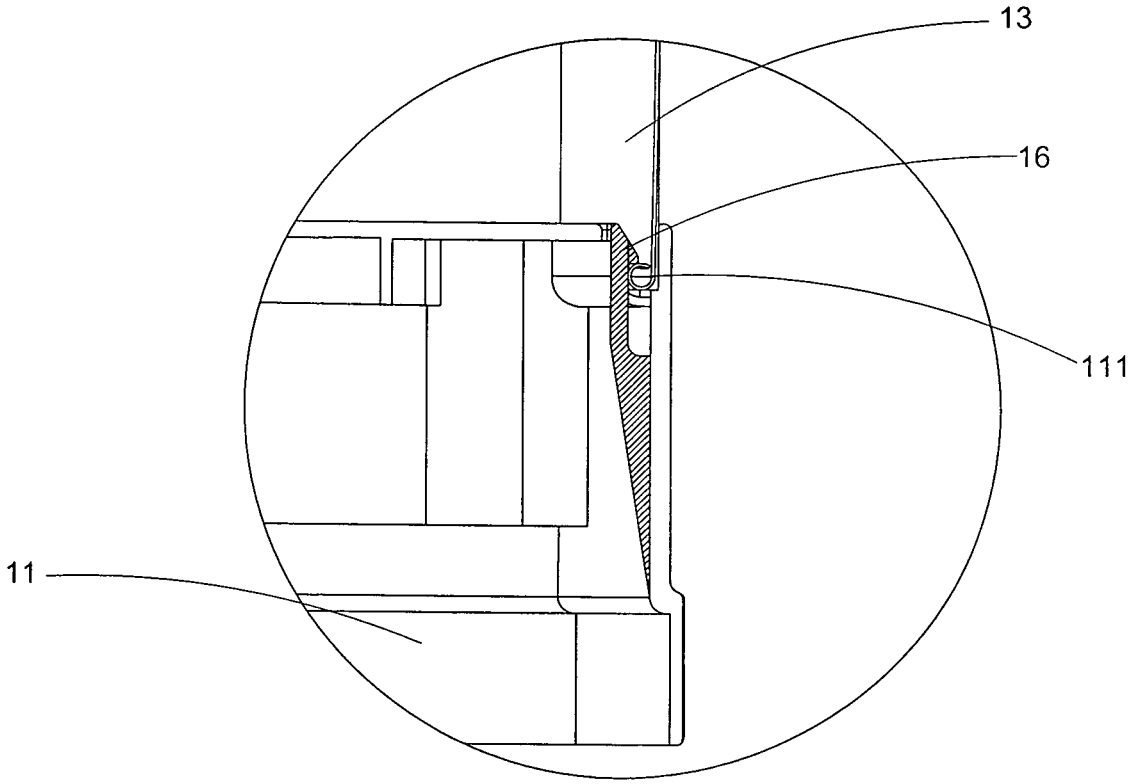
FIG. 9 is a partial enlarged view of A in FIG. 8 of the drawings.
Figure 10:
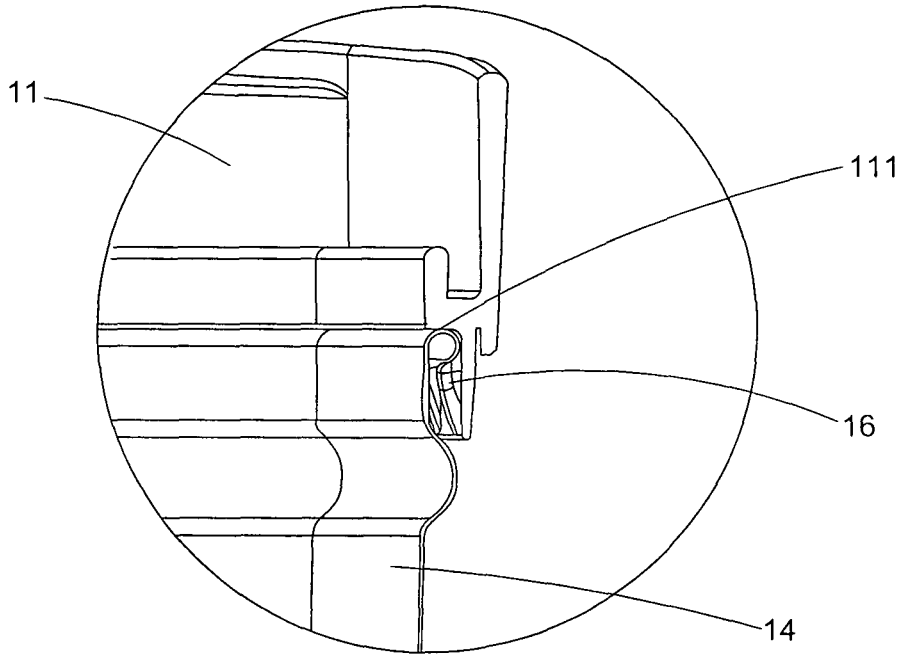
FIG. 10 is a partial enlarged view of B in FIG. 8 of the drawings.

Accordingly, the garbage bin 10 can be configured into any conventional structure. According to this preferred embodiment, two end portions of the bin body 11 are respectively provided with curling edges 111; the bin top 13 and the bin bottom 14 are respectively provided with a barb 16. Accordingly, the barbs 16 are respectively coupled with the curling edges 111, so as to mount the bin top 13 and the bin bottom 14 with the bin body 11, as shown in FIGS. 8 to 10 of the drawings.

It is worth mentioning that the bin top 13 and the bin bottom 14 can be detachably mounted to the bin body 11 via the curling edges 111 and the barbs 16. The bin top 13 and the bin bottom 14 can be installed to bin bodies 11 having different sizes. In other words, when the user wants to replace the bin body 11 with a new bin body having a relatively large size, he or she simply needs to detach the bin top 13 and the bin bottom 14 from the bin body 11 and replace a new one having a different volume. For example, a bin body having a same diameter but larger height can take place of the original bin body 12 so that a foot operation container with a larger volume is obtained.

Therefore, no other mounting means are employed for the assembly of the garbage bin 10 of the foot operation container of the present invention, and thus the assembly operation is simplified and the aesthetic appearance of the foot operation container is also enhanced. The foot operation container comprises only mechanical structures, and thus produces no pollution to the environment.

From another aspect of the present invention, the preferred embodiment of the present invention actually provides a pedal mechanism for moving the bin lid 12 of the garbage bin 10 between the open state and closed state. In other words, the pedal mechanism can be installed into any sizes of garbage bins 10 without altering the original structures of the garbage bins.

Accordingly, the pedal mechanism comprises a foot-operable pedal 20 mounted to the garbage bin 10, a pedal guide arrangement 30 provided on the garbage bin 10 for guiding the movement of the foot-operable pedal 20, a driving arrangement 40 coupled with the foot-operable pedal 20 for opening and closing the bin lid of the garbage 10, and a pedal cushion arrangement 50 for moderating the upward movement of the foot-operable pedal 20 when the foot-operable pedal 20 is released for closing the bin lid 12.

As discussed above, the effective length of pulling thread 41 of the driving arrangement 40 can be adjusted, and thus the pedal mechanism can be modified to fit any size garbage bins. The total pedal mechanism has a simple structure and can be installed into any conventional garbage bins.

The present invention further provides a method for manufacturing a foot operation container. The method comprises the following steps.

(a) Form a storing cavity 15 with an opening 131 for carrying items via a garbage bin 10 having a bin lid 12, wherein the bin lid 12 is arranged for closing the opening 131.

(b) Mount a foot-operable pedal 20 and a pedal guide arrangement 30 to the garbage bin 10 in such a manner that the foot-operable pedal 20 is capable of moving downward and upward under a guidance of the pedal guide arrangement 30.

(c) Connect the foot-operable pedal 20 and the bin lid 12 via a pulling thread 41 of a driving arrangement 40 in such a manner that when the foot-operable pedal 20 moves to pull the pulling thread 41, the pulling thread 41 is driven to pull up the bin lid 12 to open the opening 131 of the garbage bin 10.

The method may further comprises a step (d): mount a pedal cushion arrangement 50 to the foot-operable pedal 20 in such a manner that friction between a main motor 52 and a reduction gear box 51 of the pedal cushion arrangement 50 provides a resisting force to the foot-operable pedal 20 via a crank connecting rod 53, so that retracting movement of the foot-operable pedal 20 is provided with a cushion effect.

Accordingly, in the step (d), the crank connecting rod 53 is coupled with a guide hole 21 in the foot-operable pedal 20 through a floating connection.

The step (c) may further comprise a step of adjusting an effective length of the pulling thread 41 via an adjusting arrangement 42.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foot operation container, comprising:

a garbage bin comprising a bin lid;

a foot-operable pedal mounted to said garbage bin;

a pedal guide arrangement mounted to said garbage bin for enabling downward and upward movement of said foot-operable pedal; and a driving arrangement comprising a pulling thread having a first end connected to said bin lid and a second end connected to said foot-operable pedal, wherein when said foot-operable pedal is pressed by a foot of a user, said foot-operable pedal moves downward under a guidance of said pedal guide arrangement to drive said pulling thread to lift up said bin lid, wherein said driving arrangement further comprises an adjusting arrangement for adjusting an effective length of said pulling thread, so that accurate sealing position of said bin lid is ensured, wherein said pulling thread comprises a first thread section and a second thread section, wherein said adjusting arrangement comprises a connecting element, a first mounting screw, and a second mounting screw, wherein said first thread section and said second thread section are respectively connected to said connecting element via said first mounting screw and said second mounting screw, wherein said effective length of said pulling thread is adjusted by operating on said first mounting screw and said second mounting screw.

2. A foot operation container, comprising:

a garbage bin comprising a bin lid;

a foot-operable pedal mounted to said garbage bin;

a pedal guide arrangement mounted to said garbage bin for enabling downward and upward movement of said foot-operable pedal;

a driving arrangement comprising a pulling thread having a first end connected to said bin lid and a second end connected to said foot-operable pedal, wherein when said foot-operable pedal is pressed by a foot of a user, said foot-operable pedal moves downward under a guidance of said pedal guide arrangement to drive said pulling thread to lift up said bin lid; and a pedal cushion arrangement, wherein said pedal cushion arrangement comprises a crank connecting rod connected to said foot-operable pedal, a reduction gear box connected to said crank connecting rod, and a main motor coupled with said reduction gear box in such a manner that a cushion effect is provided to said foot-operable pedal via said crank connecting rod when said foot-operable pedal is released from the foot of the user, wherein said driving arrangement further comprises a thread sleeve for receiving said pulling thread, wherein said pulling thread is prevented from having frictional contact with said garbage bin, and an adjusting arrangement for adjusting an effective length of said pulling thread, so that accurate sealing position of said bin lid is ensured, wherein said pulling thread comprises a first thread section and a second thread section, wherein said adjusting arrangement comprises a connecting element, a first mounting screw, and a second mounting screw, wherein said first thread section and said second thread section are respectively connected to said connecting element via said first mounting screw and said second mounting screw, wherein said effective length of said pulling thread is adjusted by operating on said first mounting screw and said second mounting screw.

3. The foot operation container, as recited in claim 2, wherein said pedal guide arrangement comprises at least one spring, wherein when said foot-operable pedal moves downward, said spring is arranged for preventing said garbage bin from shaking, wherein when said foot-operable pedal is released from the foot of the user, said spring drives said foot-operable pedal to move back to an original position of said foot-operable pedal.

4. The foot operation container, as recited in claim 3, wherein said pedal guide arrangement further comprises a movable guide rail coupled with said foot-operable pedal, and a retaining guide rail mounted to said garbage bin, wherein said foot-operable pedal moves downward and upward along said retaining guide rail via said movable guide rail.

5. The foot operation container, as recited in claim 4, further comprises at least one roller bearing for providing a sliding movement between said movable guide rail and said retaining guide rail.

6. The foot operation container, as recited in claim 4, wherein said garbage bin further comprises a bin body defining a storing cavity, a bin top mounted to said bin body, and a bin bottom mounted to said bin body, wherein said foot-operable pedal and said pedal guide arrangement are mounted to said bin bottom, wherein said bin top defines an opening, wherein said bin lid is arranged for opening and closing said opening of said bin top, wherein said retaining guide rail is fixed to said bin bottom.

7. The foot operation container, as recited in claim 6, wherein said bin body has two curling edges provided at two end portions thereof, wherein each of said bin top and said bin bottom comprises a barb which is coupled with said curling edge in such a manner that each of said bin bottom and said bin bottom is detachably mounted to said bin body.

* * * * *